US007716955B2

(12) United States Patent
Stingel

(10) Patent No.: US 7,716,955 B2
(45) Date of Patent: May 18, 2010

(54) SINKER SET FOR THE MANUFACTURE OF PLUSH

(75) Inventor: Uwe Stingel, Messstetten (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/385,382

(22) Filed: Apr. 7, 2009

(65) Prior Publication Data

US 2009/0249836 A1 Oct. 8, 2009

(30) Foreign Application Priority Data

Apr. 7, 2008 (EP) ..... 08103408

(51) Int. Cl.
*D04B 15/06* (2006.01)

(52) U.S. Cl. ..... 66/92; 66/93

(58) Field of Classification Search ..... 66/91, 66/92, 93, 104, 105, 106, 107
See application file for complete search history.

(56) References Cited

U.S. PATENT DOCUMENTS 1,790,832 A 2/1931 O'Lena
4,535,608 A * 8/1985 Plath et al. ..... 66/9 R
4,955,211 A * 9/1990 Neher ..... 66/9 R
5,390,511 A * 2/1995 Shibata et al. ..... 66/9 R
5,791,162 A * 8/1998 Plath ..... 66/92
5,931,025 A * 8/1999 Lonati et al. ..... 66/217
6,705,129 B2 * 3/2004 Pot d'Or ..... 66/93
6,735,987 B2 * 5/2004 Plath et al. ..... 66/8

FOREIGN PATENT DOCUMENTS

DE 30 35 582 4/1982
GB 1 175 217 12/1969
WO WO 01/73178 10/2001

* cited by examiner

*Primary Examiner*—Danny Worrell
(74) *Attorney, Agent, or Firm*—Fitch, Even, Tabin & Flannery; Norman N. Kunitz

(57) ABSTRACT

A sinker set comprising a coulier sinker (11) and a plush sinker (12). The sinkers (11, 12) can be moved together in a direction transverse to a knitting needle (2). The sinkers have spaced apart edges for the accommodation of stitches. In order to adjust the distance between these edges, the sinkers (11, 12) can be moved relative toward each other in the driving-out direction of the needle. To do so, they have spaced apart guiding edges (17, 18; 27, 29, 30) that are in contact with various support surfaces or guiding surfaces (20, 22; 26, 32, 33).

10 Claims, 3 Drawing Sheets

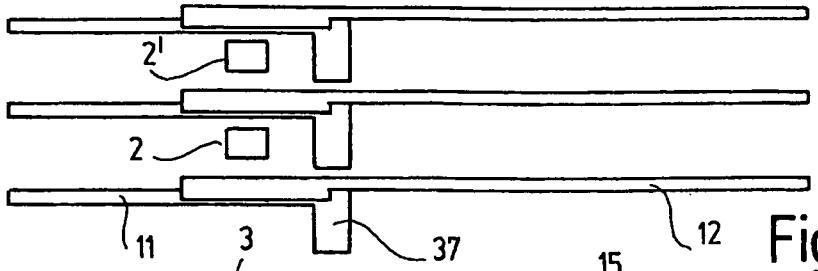
Fig.4
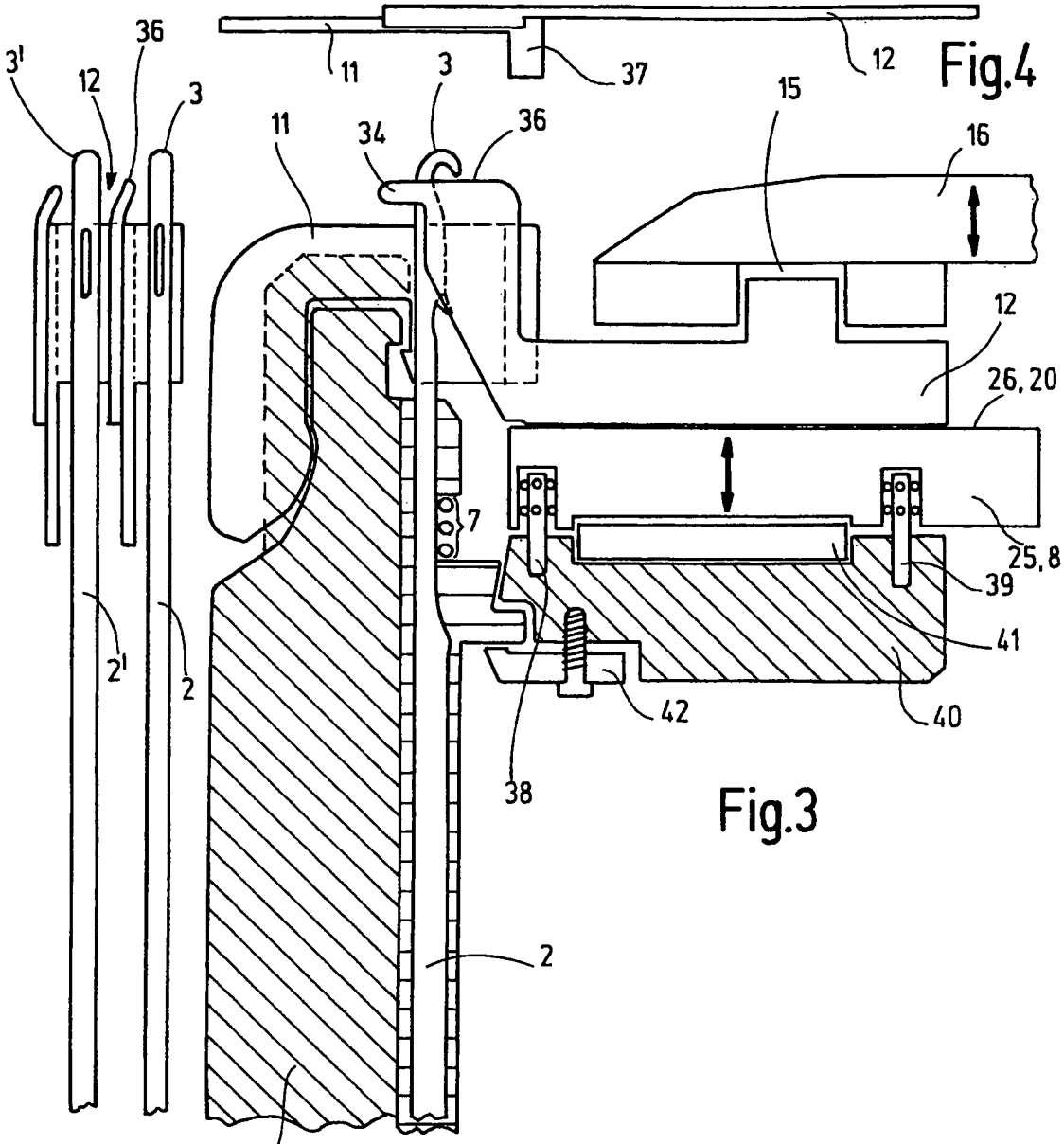
Fig.3
Fig.5

SINKER SET FOR THE MANUFACTURE OF PLUSH

CROSS-REFERENCE TO RELATED APPLICATION

The present application claims the priority of European Patent Application No. 08 103 408.4, filed Apr. 7, 2008, the subject matter of which, in its entirety, is incorporated herein by reference.

BACKGROUND OF THE INVENTION

The invention relates to a sinker set for knitting systems for the manufacture of plush goods, in particular for use in circular knitting machines. In terms of the present patent application, a knitting system comprises all parts necessary for the formation of a pair of stitches, said pair consisting of a base stitch and a plush stitch.

For example, knitting systems as have been known from DE 30 35 582 C2, DE 31 45 307 C2 or even DE 41 29 845 A1 are used for the manufacture of plush. Such knitting systems comprise at least one needle as well as a sinker with one slit-like recess extending in transverse direction of the needle. Above the slit, the sinker has a (downholder) lug aligned in transverse direction of the needle, said needle's upper edge being disposed to receive a plush loop. The edge located in the slit acts as the coulier edge.

Considering this, document DE 30 35 582 discloses a special solution which provides a second sinker in addition to the sinker with the slit, said second sinker's flat side abutting against the first-mentioned sinker. The second sinker has a projection which can partially cover the slit of the first sinker. In so doing, it is possible to change the effective slit length due to the relative shift between the two sinkers, for example, in order to restretch the plush loops after the associated needle has been driven out.

This mode of operation of such a known stitch-forming system follows a common principle. Base and plush threads are separately fed to a suitable thread guide. In the conventional manner, the base thread comes to lie on the drawing-down (coulier) edge of the plush sinker, whereas the plush thread lies on said upper sinker lug that is raised relative to the coulier. Subsequently, the newly formed stitches, base threads and plush threads are drawn down together. Known embodiments with only one sinker per knitting system as well as systems with two sinkers per knitting system follow this principle.

In so doing, the height of the plush loops results from the distance of the coulier of the plush sinker from the inside edge of the hook of the (latch-type) needle and thus from the dimensions of the plush sinkers that are being used. If the plush loop height is to be changed, the plush sinkers must be exchanged. This involves a considerable effort, considering the, e.g., 4000 sinkers per circular knitting machine.

In addition, special sinkers have been known from prior art, said sinkers permitting an adjustment of the plush loop height. Regarding these, reference is made to document JP 2005-299056 A. This publication discloses a base sinker having a drawing-down edge and a plush sinker that is pivotally supported on the base sinker and has a lug projecting at a variable distance beyond the drawing-down edge. The plush sinker is associated with an adjustment device disposed so as to allow the defined adjustment of the pivot position of the plush sinker.

The adjustment of the pivot position of the plush sinker is critical. If the pivot position is not the same for all knitting systems and plush sinkers, uniform plush goods cannot be obtained. Rather, the formation of streaks would have to be expected.

Considering this, it is the object of the invention to provide a possibility of adjusting the plush loop height on a knitting machine as desired.

SUMMARY OF THE INVENTION

In accordance with the invention, the above object is achieved with a sinker set in accordance with Claim 1:

The sinker set in accordance with the invention permits a simple adjustment of the plush loop height. Its use requires neither a complex plush sinker pivot mechanism nor is an exchange of the sinkers in a circular knitting machine required when the plush loop height is to be adjusted. This is achieved in that sinker pairs consisting of a coulier sinker and a plush sinker are provided, said coulier sinker and said plush sinker being associated with different guiding surfaces of a sinker bed. Preferably, both sinkers are arranged together in a single channel of the sinker ring. The sinkers may be controlled in the conventional manner by sinker cams that act on the sinker feet. Basically, a cam path shared by both sinkers is sufficient for driving. The sinkers are synchronously moved through this cam path in the longitudinal direction of the sinkers. Alternatively, it is possible to provide two or more cam paths to allow the separate control of the sinkers, i.e., to be able to move them back and forth, independently of each other.

The idea of the invention permits the adjustment of the coulier sinker and the plush sinker relative to each other in a height direction. The height direction is understood to be perpendicular to the bottom of the channel of the sinker ring, i.e., parallel to the channel walls and transverse to the sinker longitudinal direction. Preferably, only the height of the plush sinker is adjusted, whereas the coulier sinker is not adjusted. Accordingly, the plush sinker is associated with height-adjustable guiding surfaces of the sinker bed, whereas the coulier sinker is associated with height-non-adjustable guiding surfaces of the sinker bed. The adjustable guiding surfaces are provided on the correspondingly adjustable support elements. In so doing, the height of the coulier sinker may be adapted to the needle stroke that is not variable in most cases. Due to the height adjustment of the plush sinker, the length of the plush loops and thus also the pile height of the plush to be produced can be adjusted.

Preferably, the guiding surfaces of the sinker bed are adjustable support elements that are arranged in the channels of the sinker ring or can be separate elements, e.g., elements arranged on the knitting cylinder. The adjustable elements and their guiding surfaces extend transversely to the channels in which the sinkers are seated. The relative adjustment of the coulier sinker and the plush sinker may also be accomplished by a the relative adjustment of the sinker ring and the knitting cylinder, e.g., when the coulier sinkers are supported on the knitting cylinder and the plush sinkers are supported on the sinker ring.

The coulier sinker and the plush sinker are seated on the guiding surfaces, preferably with their straight edges, and slide on the guiding surfaces. In so doing, the guiding edges are preferably aligned in the longitudinal direction of the sinkers. The guiding edges of the coulier sinker and the guiding edges of the plush sinker are preferably at a distance from each other in longitudinal direction in order to come into engagement with the different guiding surfaces of the sinker bed. Additionally or alternatively, the guiding edges of the plush sinker may be at a distance from the guiding edges of the coulier sinker in height direction, i.e., in a direction transverse to the longitudinal direction of the edge. In so doing, a compact construction of the guide elements can be achieved.

Preferably, at least one of the two sinkers is provided with a recess at the location where the adjacent sinker has a guiding edge. In this manner, it can be ensured that each sinker comes into engagement only with its associate guiding surface. In so doing, the coulier sinkers associated with the sinker set in accordance with the invention are different from those in accordance with prior art in that, basically, recesses are provided that prevent the height adjustment device associated with the plush sinkers from acting on the coulier sinkers.

The two sinkers of the sinker set in accordance with the invention are arranged together in a channel of the sinker ring. Therefore, the plush sinker is not situated on the bottom of the guide channel but on at least a support element, said element being height-adjustable. A second support may be provided in that a height-adjustable holding element comes into engagement, e.g., with a front-side recess of the plush sinker.

The plush sinker may be configured with or without a downholder lug. The individual elements of the height adjustment device may be arranged at various points of the circular knitting machines, for example, on the sinker carrier ring and/or on the knitting cylinder.

In principle, the plush sinker and the coulier sinker may be connected to each other, whereby the connection permits a relative movement of the two sinkers at least as to height. Preferably, the plush sinker and the coulier sinker, however, are in a loose relationship with each other. That is, they are not connected to each other, but they are seated together—flat side against flat side—in the guide channel of the respective sinker bed (for example, of the sinker ring) and are held together by the walls of the sinker channel.

Additional details of advantageous embodiments of the invention are obvious from the description, the drawings or the claims. The descriptions is restricted to essential aspects of the invention and miscellaneous situations. The drawings are to be referred to in a supplementary manner. They disclose additional details.

The drawings illustrate examples of the invention.

BRIEF DESCRIPTION OF THE DRAWINGS

FIG. 3 is a vertical sectional view of another exemplary embodiment of a knitting system.

FIG. 4 is a plan view of the knitting systems in accordance with FIG. 3.

FIG. 5 is a front view of the knitting systems in accordance with FIG. 3.

DETAILED DESCRIPTION OF THE INVENTION

Figure 1:
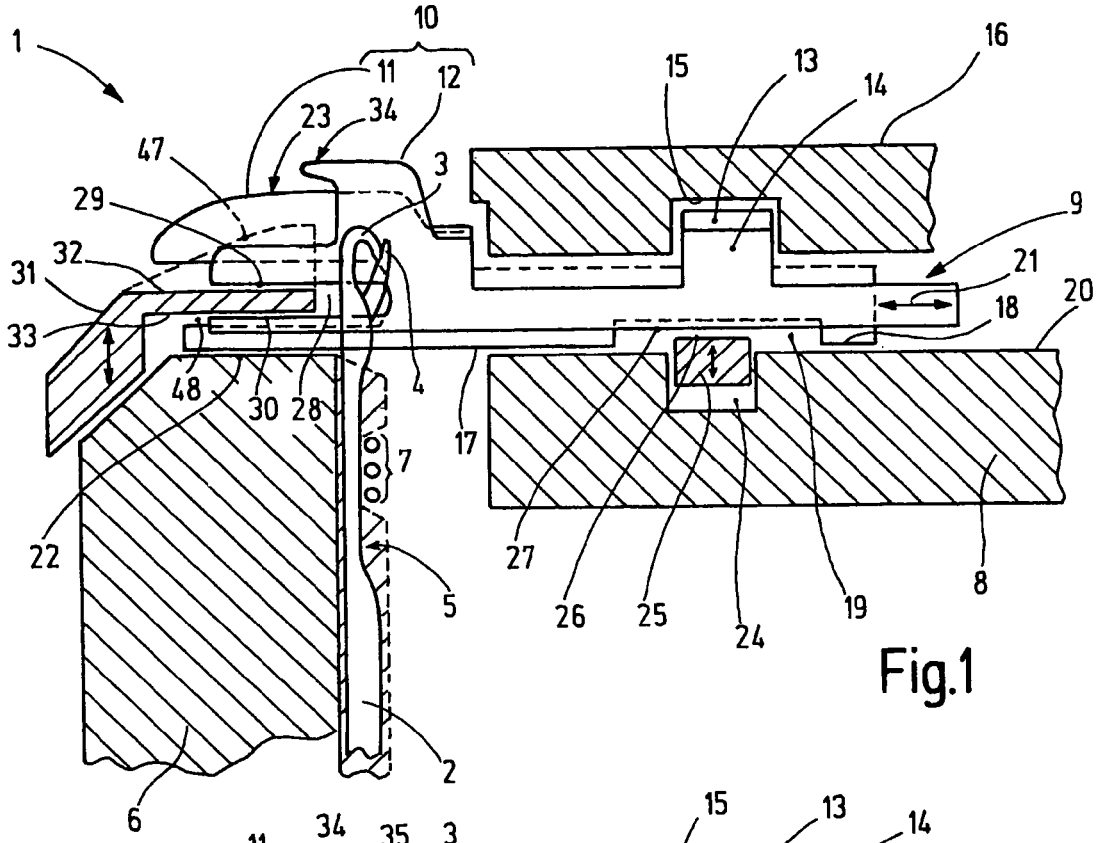
FIG. 1 is a schematic vertical sectional view of a knitting system embedded in the sinker ring and the knitting cylinder.

FIG. 1 shows a knitting system for the manufacture of a knitted material with plush. The knitting system comprises a needle 2, e.g., in the form of a latch-type needle. The needle 2 has a shaft which has a hook 3 at its end. This hook is associated with a pivotally supported latch 4. The needle 2 is held in a needle channel 5 of a knitting cylinder 6 so as to be movable in longitudinal direction, i.e., considering the exemplary embodiment, in vertical direction. Cylinder springs 7 retain the needle 2 in the respective needle channel.

The knitting cylinder 6 is associated with a sinker ring 8 that has radially oriented channels 9 for receiving sinker pairs 10. Channel walls oriented radially and vertically and delimiting the channel 9 do exist, however, are not shown. Each sinker pair 10 comprises a coulier sinker 11 and a plush sinker 12. The coulier sinker 11 and the plush sinker 12 are flat sheet metal parts that abut against each other on their flat sides that face each other. Each of said sinkers has a driving foot 13, 14 that extends into a cam channel 15 of a sinker cam 16. A relative rotation of the sinker cam 16 against the sinker ring 8 about a vertical axis of rotation, said axis being concentric to the axis of rotation of the needle cylinder 6, results in a synchronous movement of the coulier sinker 11 and the plush sinker 12 whose driving feet 13, 14 follow the non-circular cam channel 15.

Referring to FIG. 1, the coulier sinker 11 has, on its lower narrow side, a guiding edge 17, 18 that is interrupted by a recess 19 and that faces the bottom 20 of the sinker channel 9. The bottom 20 forms a guiding surface for the guiding edge 17, 18. The coulier sinker 11 slides back and forth on the bottom 20 in longitudinal direction 21 of the sinker, said direction coinciding with the radial direction of the sinker ring 8 and coinciding with the longitudinal direction of the guiding edge 17, 18.

The guiding edge 17 may have a length such that it moves past the needle 2 in order to slide, if required, on another guiding surface 22 that is provided, for example, on the upper ring-shaped end face of the needle cylinder 6.

The guiding edge 17 may also be configured as two parallel planes that are at a distance from each other in view of height.

The height of the coulier sinker 11 is not adjustable. Independent of any other selected setting, said sinker operates on the bottom 20 by sliding back and forth at the given height. Said sinker's upper edge 23 provided on its front end is disposed to act for couliering the knit fabric.

The plush sinker 12 belonging to the sinker pair 10 is arranged so as to be height-adjustable. To do so, a channel 24 extending along the bottom 20 of the sinker ring 8 is provided, said channel extending transversely to the sinker channel 9. The channel 24 contains a height-adjustable support 25 whose upper side forms a guiding surface 26 for the plush sinker 12. On its underside, the plush sinker 12 has a straight guiding edge 27 that can slide back and forth on the guiding surface 26 in longitudinal direction of the edge (arrow 21). In so doing, the support 25 preferably remains at rest and defines the height position on which the plush sinker 12 is sliding. The actual guiding edge 27 is that part of the lower narrow side of the plush sinker 12 that can come into contact with the support surface 26. Considering the support surfaces 20, 22, the same applies with respect to the guiding edge 17. Like the guiding edge 17 of the sinker 11, the guiding edge 27 of the plush sinker 12 may also be located in two parallel planes at a distance from each other as to height.

On its front end adjacent to the head of the needle 2, the plush sinker 12 may have a longitudinal slit 28 that is delimited by two preferably straight edges 29, 30. This longitudinal slit 28 extends in longitudinal direction of the needle. Said longitudinal slit is disposed to act as a support slit for the support of the plush sinker 12 on a height-adjustable support 31 that is provided, e.g., on the end face of the knitting cylinder 6. The edges 29, 30 form guiding edges that are preferably associated with planar guiding surfaces 32, 33 of the height-adjustable support 31. Strips 47 (indicated in dashed lines in FIG. 1) may be provided between the individual pairs of sinkers 20 on the support 31, whereby the coulier sinker 11 and the plush sinker 12 are mounted between said strips.

As is obvious from FIG. 1, the guiding edges 17,18 of the coulier sinker 11 are at a distance from the guiding edge 27 of the plush sinker, relative to the longitudinal direction 21 of the sinker. As opposed to this, the guiding edges 27, 30 of the plush sinker 12 are at a distance from the guiding edge 17 of the coulier sinker 11, i.e., relative to the direction of height. In the vicinity of the guiding edge 27 of the plush sinker 12, the coulier sinker 11 has the recess 19. In its end region away from the driving foot 14 and in the vicinity of the guiding edge 17 of the coulier sinker 11, the plush sinker 12 has a recess in the form of the slit 28. In its end region away from the driving foot 13, the coulier sinker 11 has a slit 48. The dimensions of this slit 48 are greater than those of the slit 28 of the plush sinker 12; preferably, it is of a greater height. As a result of this, the support 31 that extends into the slit 48 may be adjustable as to height, without thereby affecting the position of the coulier sinker 11. In addition, the support 31 extends into the slit 28 of the plush sinker 12 and may be used to adjust the height of said sinker. The height of the slit 48 of the coulier sinker 11 defines the range of motion of the slit 28 in vertical direction of the plush sinker 12.

The plush sinker 19 has a plush lug 34 for the temporary accommodation of a half-stitch for the formation of plush loops. By adjusting the height of the plush sinker 12 with respect to the coulier sinker 11, it is possible to adjust the vertical distance of the upper edge of the plush lug 34 from the edge 23, and thus the size or length of the plush loops. The plush lug 34 additionally acts as a downholder for the knit fabric located below said plush lug.

The knitting system described so far works as follows:

During operation, the needle 2 is moved up and down in vertical direction, whereby—in driven-out state, said needle picks up a base thread and a plush thread, respectively. With the base thread, the needle forms a knit fabric in that—during its reverse stroke—it pulls the thread through the half stitch seated on the needle shaft, said half stitch being seated on the edge 23. In so doing, the needle sets the plush thread on the plush lug 34.

If large plush loops are to be knitted, the plush sinker 12 must be adjusted upward. This is accomplished in that the supports 25, 31 are adjusted upward in vertical direction, i.e., synchronously to each other and relative to the knitting cylinder and to the sinker ring 8. As opposed to this, in order to make the plush loops smaller, the supports 31, 25, are adjusted downward in vertical direction. The adjustment motion is approximately parallel to the drive-out motion of the needle 2 and transverse to the longitudinal direction 21 of the sinkers 11, 12.

Figure 2:
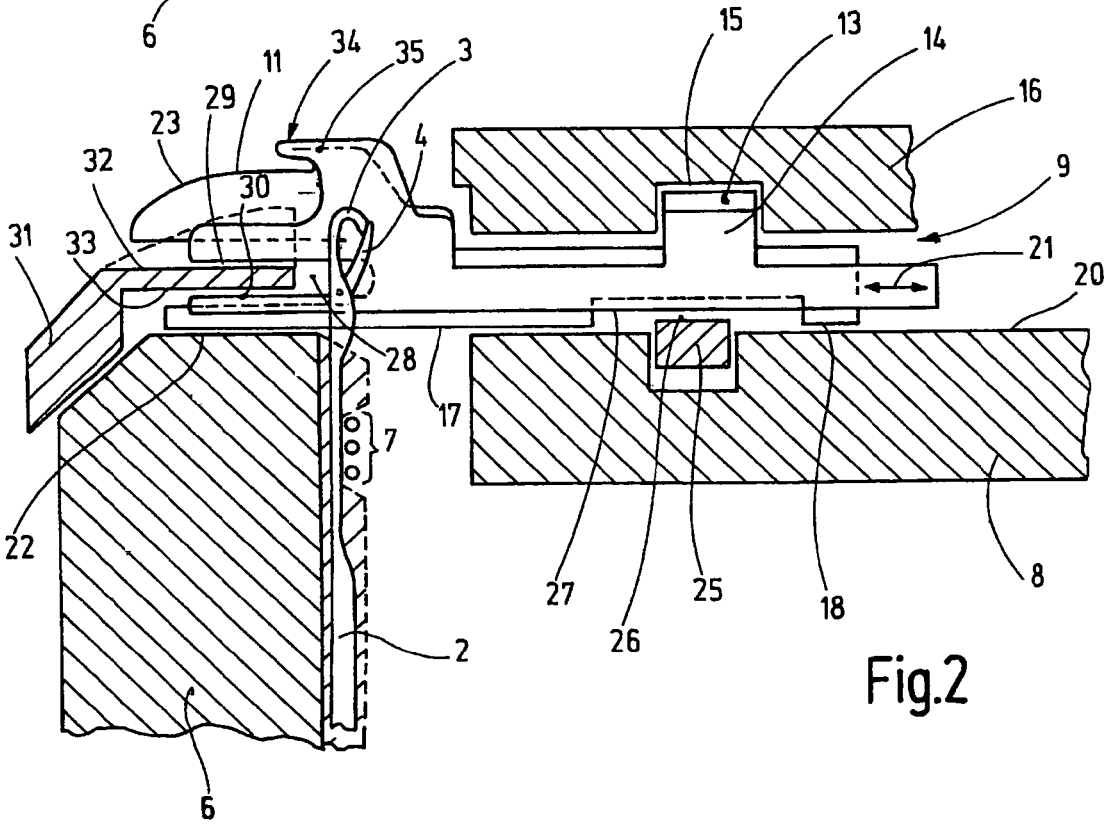
FIG. 2 is a corresponding illustration of a knitting system, in a modified embodiment.

FIG. 2 illustrates a slightly modified exemplary embodiment. Using the same reference signs, the above description applies accordingly. In addition, it is pointed out that the coulier sinker 11 is provided with a downholder 35 indicated in dashed lines, said downholder being located next to the plush lug 34. The downholder 35 is disposed to prevent the rising of the knit fabric when the needle 2 is driven out. This function that is usually performed by the plush lug 34 of the plush sinker 12 is now transferred to the downholder 35 of the coulier sinker 11. As a result of this, larger adjustment strokes between the coulier sinker 11 and the plush sinker 12 are possible, without negatively affecting their function.

FIGS. 3 through 5 show a modified embodiment of the above-described knitting system. In the description hereinafter, the same names and reference signs are used for the parts that essentially correspond to the above-described parts, in particular regarding their function, while reference is made to the above description in addition to the explanation hereinafter.

Referring to the embodiment in accordance with FIG. 3, the plush sinker 12 is arranged in the sinker channel of the sinker ring 8, whereas the drawing-down sinker or coulier sinker 11 is seated in corresponding channels provided on the knitting cylinder 6. In this exemplary embodiment, the sinker ring 8 assumes the function of the support 25, and the guiding surface 26 assumes the function of the bottom 20. Preferably, the coulier sinker 11 is held in a positive-locking manner on the knitting cylinder 6. As a result of this, the coulier sinker 11 is held in place in a stationary manner and does not have a driving foot. Such channels may extend, for example starting from the end face of the knitting cylinder 6, over one of its wall surfaces. The drawing-down sinker 11 that is used for stitch formation overlaps with the working part of the plush sinker 12 in the vicinity of the needle 2 or the hook 3. Preferably, the plush sinker 12 is configured as a flat piece of sheet metal that may be laterally angled on the plush lug 34 and on its adjoining part. As is shown by FIG. 5, this feature may be utilized to adjust the upper edge 36 of the plush sinker 12 in the center between adjacent needles 2, 2' or their hooks 3, 3'. As is shown in particular by FIG. 4, the drawing-down sinker 11 may have a wide support section 37 that bridges the distance between adjacent plush sinkers 12.

Referring to this embodiment, the entire sinker ring 8 may be configured so as to be height-adjustable. Likewise, the sinker cam 16 may be synchronously height-adjustable in order to maintain a constant distance between the sinker cam 16 and the sinker ring 8. The sinker ring 8 may be supported so as to be vertically adjustable by means of linear guides 38, 39. The linear guides 38, 39 may be arranged on a sinker carrier ring 40. For height adjustment, a height adjustment device 41 is then provided, e.g., between the sinker carrier ring 40 and the sinker ring 8. The sinker carrier ring 40 may be attached to the needle cylinder 6 by means of a clamping device 42.

Figure 6:
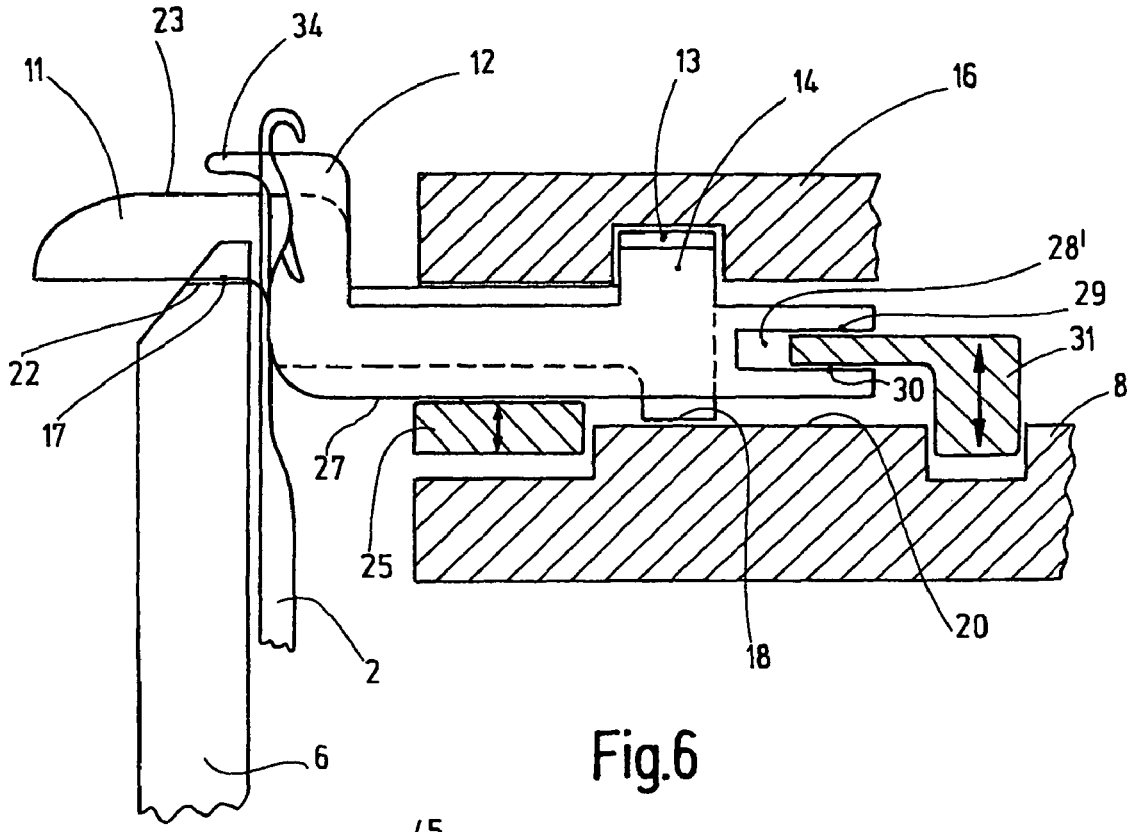
FIG. 6 is a schematic vertical sectional view of another modified embodiment of a knitting system.
Figure 7:
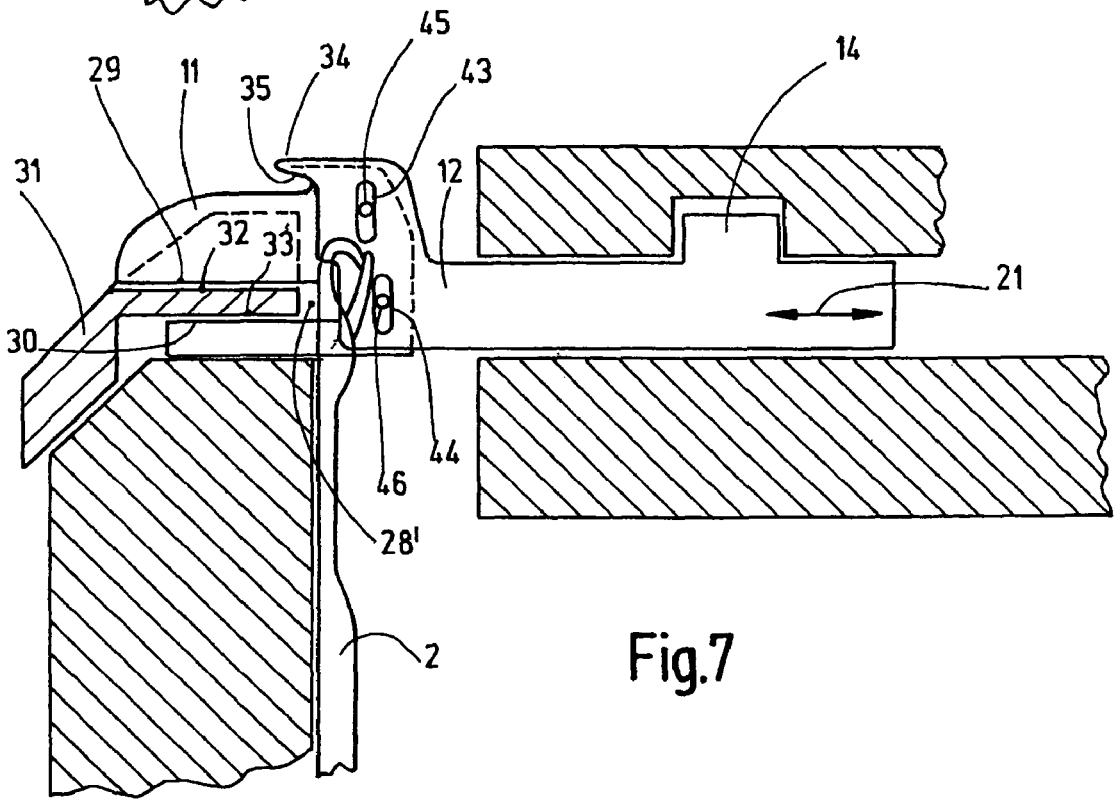
FIG. 7 is a vertical sectional view of another modified embodiment of the knitting system.

FIG. 6 shows another modified embodiment. Fundamentally, is based on the embodiment in accordance with FIG. 1 or 2, whereby using the same reference signs, reference is made to the corresponding description. Different from the respective description, however, the support 31 is not arranged on the knitting cylinder 6 but on the sinker ring 8. A corresponding projection of the support 31 comes into engagement with a slit 28' that is located on the rear end of the plush sinker 12. As opposed to this, the support 25 is arranged at a radial distance from the support 31, e.g., on the end of the sinker ring 8 facing the knitting cylinder 6. Whereas the guiding edges 27, 29, 30 of the plush sinker 12 are supported on the adjustable supports 25, 31, the guiding edges 17, 18 of the coulier sinker 11 are supported on elements and surfaces 20, 22 that are stationary relative to the driving-out direction of the needle 2.

The adjustment of the plush size is achieved by adjusting the height of the plush lugs 34 with respect to the edge 23 of the coulier sinker 11 as described above.

Based on the above-described embodiments, another embodiment of the invention is possible, whereby the coulier sinker 11 is driven by the plush sinker 12. Only the plush sinker 12 has the foot 14, whereas the coulier sinker 11 is connected to the plush sinker 12, viewed in longitudinal direction 21 of the sinker. Viewed in the adjustment direction that corresponds to the driving-out direction of the needle, the coulier sinker 11 may be moved toward the plush sinker 12. This is made possible by linear guides, for example, cam guides configured as long holes 43, 44 that are provided in one of the sinkers, for example, the plush sinker 12; whereas lugs, pins or other projections 45, 46 extending into these long holes 43, 44 are effective to attach the coulier sinker 11. The adjustment of the plush sinker 12 relative to the coulier sinker 11 is achieved by the height adjustment of the coulier sinker 11 by means of the support 31. The latter comes into engagement with the slit 28' which, in this case, is provided on the coulier sinker 11. This feature also allows a height adjustment of the plush loops.

A sinker set is being suggested, with the sinker set comprising a coulier sinker 11 and a plush sinker 12. The sinkers 11, 12 can be moved together in a direction transverse to a knitting needle 2. Said sinkers have spaced apart edges for the accommodation of stitches. In order to adjust the distance between these edges, the sinkers 11, 12 can be moved relative toward each other in the driving-out direction of the needle. To do so, they have spaced apart guiding edges 17, 18; 27, 29, 30 that are in contact various support surfaces or guiding surfaces 20, 22; 26, 32, 33.

It will be appreciated that the above description of the present invention is susceptible to various modifications, changes and modifications, and the same are intended to be comprehended within the meaning and range of equivalents of the appended claims.

LIST OF REFERENCE NUMERALS

1 Knitting system
2, 2' Needle
3, 3' Hooks
4 Latch
5 Needle channel
6 Knitting cylinder
7 Cylinder springs
8 Sinker ring
9 Sinker channel
10 Sinker pair
11 Coulier sinker
12 Plush sinker
13, 14 Driving foot
15 Cam channel
16 Sinker cam
17, 18 Guiding edge
19 Recess
20 Bottom
21 Sinker longitudinal direction
22 Guiding surface
23 Edge
24 Channel
25 Support
26 Guiding surface
27 Guiding edge
28, 28' Longitudinal slit
29, 30 Edges/guiding edges
31 Support
32, 33 Guiding surfaces
34 Plush lug
35 Downholder
36 Edge
37 Support section
38, 39 Linear guide
40 Sinker carrier ring
41 Height adjustment device
42 Clamping device
43, 44 Long holes
45, 46 Lugs
47 Strips
48 Slit

What is claimed is:

1. Sinker set for knitting systems for production of plush goods, comprising:

a coulier sinker and a plush sinker, each having flat sides and; when in use, abutting against each other on two flat sides that face each other, and wherein the coulier sinker and the plush sinker have guiding edges at a distance from each other, said guiding edges being associated with various guiding surfaces of a sinker receiving device in which the sinkers are mounted with at least one of the sinkers being mounted for driven movement in a longitudinal direction of the sinkers and transverse to a longitudinal direction of a needle associated with both sinkers; and wherein at least some of said guiding surfaces are moveable in the longitudinal direction of the needle and engage certain of said guiding edges to adjust the relative positions of said sinkers in the longitudinal direction of the needle independently of one another.

2. Sinker set in accordance with claim 1, wherein the guiding edges are straight edges.

3. Sinker set in accordance with claim 1, characterized in that wherein the guiding edges are aligned in a longitudinal direction of the sinkers.

4. Sinker set in accordance with claim 1, wherein the various guiding edges of the sinkers are at a distance from each other in a longitudinal direction of the sinkers.

5. Sinker set in accordance with claim 1, wherein, adjacent to a guiding edge of one of the sinkers, a recess of the other sinker is arranged.

6. Sinker set in accordance with claim 1, wherein the coulier sinker and the plush sinker are driven by a common drive device.

7. Sinker set in accordance with claim 1, wherein the coulier sinker and the plush sinker each comprises a driving foot.

8. Sinker set in accordance with claim 7, wherein the driving feet of the coulier sinker and of the plush sinker communicate with the same cam.

9. Sinker set in accordance with claim 1, wherein said guiding edges are aligned in the longitudinal direction of the sinkers.

10. Sinker set in accordance with claim 9, wherein said guiding edges that are engaged by said movable guiding surfaces are located on the plush sinker.

* * * * *